United States Patent [19]

Thorson

[11] 4,343,601

[45] Aug. 10, 1982

[54] FLUID PRESSURE DEVICE AND SHUTTLE VALVE ASSEMBLY THEREFOR

[75] Inventor: Clayton W. Thorson, Edina, Minn.

[73] Assignee: Eaton Corporation, Cleveland, Ohio

[21] Appl. No.: 142,493

[22] Filed: Apr. 21, 1980

[51] Int. Cl.[3] ..... F01C 21/16; F03C 2/08; G05D 11/00; F16K 31/122

[52] U.S. Cl. ..... 418/61 B; 137/112; 251/31

[58] Field of Search ..... 418/61 B; 60/468; 251/31; 137/112, 113

[56] References Cited

U.S. PATENT DOCUMENTS

| | | | |
|---|---|---|---|
| 2,781,639 | 2/1957 | Badalini | 137/112 |
| 3,863,449 | 2/1975 | White, Jr. | 418/61 B |
| 4,040,439 | 8/1977 | Uppal | 60/468 |

FOREIGN PATENT DOCUMENTS

| | | | |
|---|---|---|---|
| 367024 | 3/1963 | Switzerland | 137/112 |

*Primary Examiner*—John J. Vrablik

*Attorney, Agent, or Firm*—C. H. Grace; L. J. Kasper

[57] ABSTRACT

A rotary fluid pressure device is disclosed of the type including a valve housing (19) defining a pair of fluid ports (41,43) and a shuttle port (85). The device includes a fluid pressure actuated displacement mechanism (15), and a rotatable valve member (53) which provides fluid communication from one of the ports to expanding volume chambers (27) of the displacement mechanism, and from the contracting volume chambers to the other fluid port. The device includes a shuttle valve assembly including a shuttle piston (97) having end portions (103,105) disposed within a pair of fluid chambers (77,79). A dampening sleeve (115,121) is disposed about each end portion of the piston and cooperates therewith to define a dampening orifice (127,129) to prevent hunting during low pressure operation. The sleeves are radially movable within the fluid chambers to receive the end portion of the piston therein without concentricity problems, but each sleeve includes a flange portion (117,123) to limit radial movement and guide the shuttle assembly during axial movement.

9 Claims, 4 Drawing Figures

FLUID PRESSURE DEVICE AND SHUTTLE VALVE ASSEMBLY THEREFOR

BACKGROUND OF THE DISCLOSURE

The present invention relates to rotary fluid pressure devices, and more particularly, to such devices which are used in closed loop hydraulic circuits, wherein the rotary fluid pressure device includes a shuttle valve arrangement.

Although it should become apparent from the subsequent description that the invention may be useful with many types of rotary fluid pressure devices, including both pumps and motors, it is especially advantageous when used with a low speed, high torque hydraulic motor, and will be described in connection therewith. Furthermore, although the invention may be used with fluid pressure devices having various types of displacement mechanisms, the invention is especially useful in a device including a gerotor displacement mechanism, and will be described in connection therewith.

The use of low speed, high torque gerotor motors is becoming increasingly common in closed loop hydraulic circuits, i.e., a circuit in which the outlet port of the motor is connected directly to the inlet port of the pump, rather than to the system reservoir. This is especially true in regard to mobile applications, such as construction equipment in which hydraulic motors are used to drive the vehicle wheels.

In closed loop circuits of the type described, it is frequently necessary to divert a portion of the return fluid flow, from the motor to the pump, and pass it through a heat exchanger to prevent overheating of the system fluid. This is normally accomplished by means of a shuttle valve assembly installed in the motor to provide fluid communication between the low pressure side of the motor and a shuttle port. The shuttle port is then connected by means of a cooler line to the inlet of a heat exchanger, and after passing through the heat exchanger, this diverted fluid flows to the pump inlet.

One of the problems associated with hydraulic motors having shuttle valves has been a condition referred to as "hunting" of the shuttle valve. This typically occurs when the motor is operating at a relatively low pressure differential which causes the shuttle valve to become unstable. The low pressure differential can cause the shuttle piston to oscillate (or "hunt") rapidly, causing a clicking noise which may be mistakenly interpreted by the vehicle operator as a malfunction in the drive system associated with the motor. The oscillation of the shuttle valve may also result in unnecessary fatigue of the shuttle valve parts.

SUMMARY OF THE INVENTION

Accordingly, it an object of the present invention to provide an improved fluid pressure operated device of the type including a shuttle valve assembly which overcomes the problems of instability and hunting.

It is a more specific object of the present invention to provide a shuttle valve assembly which accomplishes the above-stated objects by providing dampening orifices to dampen the movement of the shuttle piston, thereby preventing rapid oscillation of the piston.

The above and other objects of the present invention are accomplished by the provision of an improved rotary fluid pressure device which comprises a housing means, a fluid pressure actuated displacement mechanism, an output shaft, and a valve means. The housing means defines a high pressure fluid port, a low pressure fluid port and a shuttle port. The displacement mechanism includes a movable member and defines expanding and contracting volume chambers during movement of the movable member, the movement including a rotational component. The output shaft is operable to transmit the rotational component of movement of the movable member. The valve means is disposed within the housing and cooperates therewith to define a first fluid passage providing fluid communication between the high pressure and the expanding volume chambers, and a second fluid passage providing fluid communication between the low pressure port and the contracting volume chambers. The device further includes a shuttle valve means including means defining a shuttle bore in fluid communication with the shuttle port, and high and low pressure chambers in fluid communication with the first and second fluid passages, respectively. The shuttle valve means includes an axially movable shuttle piston assembly including a piston member having a first end normally extending into the high pressure chamber and a second end normally extending into the low pressure chamber. The shuttle valve means includes dampening means disposed within the high pressure chamber and being radially movable therein. The dampening means defines an interior surface adapted to receive the first end of the shuttle piston and be closely spaced apart therefrom to define a dampening orifice therebetween, the interior surface of the dampening means, and the first end of the shuttle piston cooperating to define an included fluid pocket. The fluid pressure in the pocket is effective to bias the shuttle piston toward a position permitting fluid communication between the low pressure chamber and the shuttle port, and the dampening orifice provides substantially restricted fluid communication between the high pressure chamber and the fluid pocket.

DESCRIPTION OF THE PREFERRED EMBODIMENT

Figure 1:
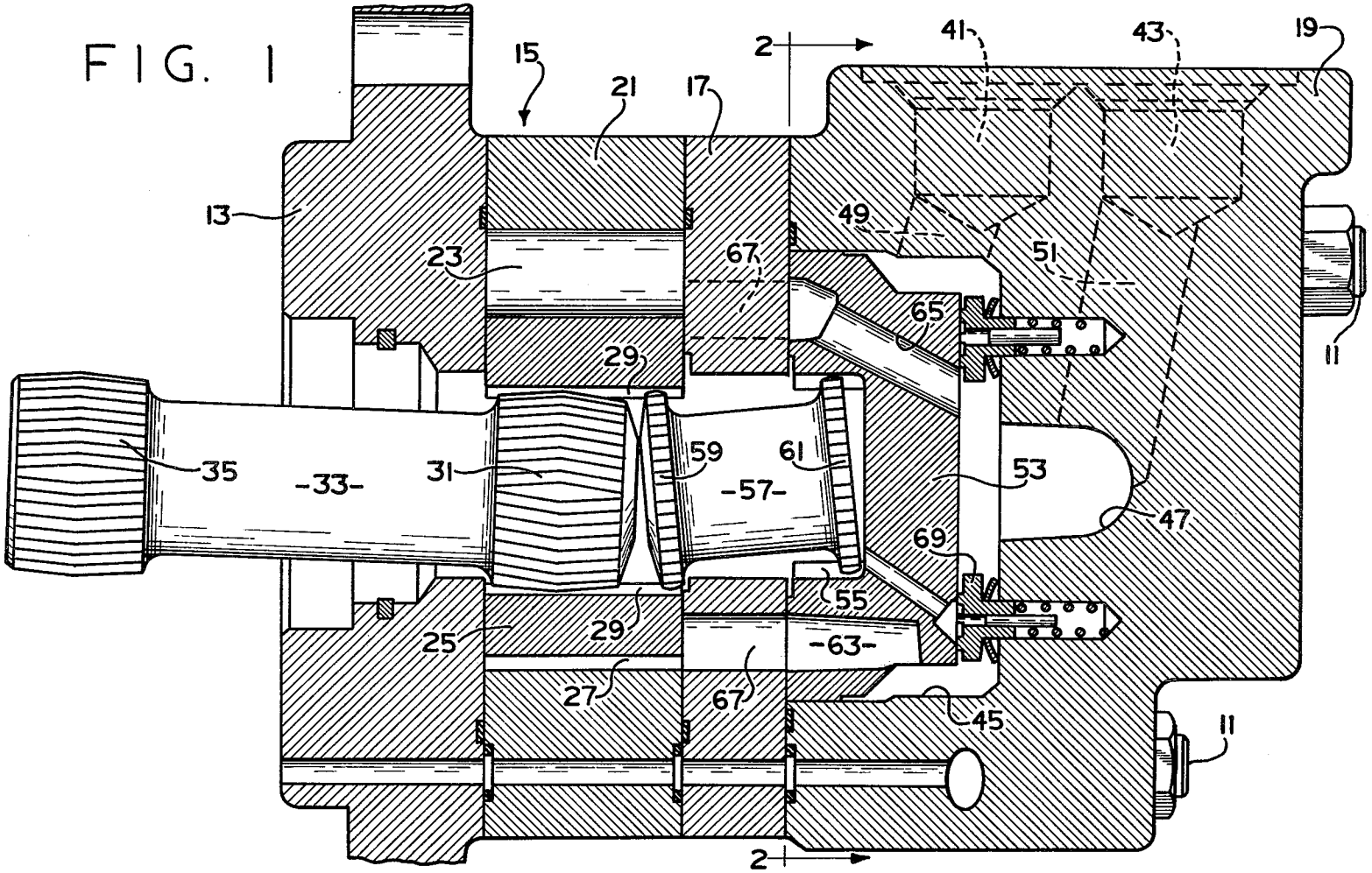
FIG. 1 is an axial cross section of a fluid pressure operated motor of the type with which the present invention may be utilized.

Referring now to the drawings, which are not intended to limit the invention, FIG. 1 is an axial cross section of a fluid pressure actuated motor of the type to which the present invention may be applied, and which is illustrated and described in greater detail in U.S. Pat. No. 3,572,983, assigned to the assignee of the present invention. It should be noted that U.S. Pat. No. 3,572,983 illustrates what is referred to as a "standard motor", whereas FIG. 1 illustrates a "bearingless motor". The distinction between a standard motor and a bearingless motor will be described further during the subsequent description of FIG. 1. However, the use of the present invention is not limited to a bearingless motor, and the design details of the hydraulic motor are generally irrelevant to the present invention, except as specifically noted hereinafter. It should be understood that the term "motor" when applied to such fluid pressure devices is also intended to encompass the use of such devices as a pump.

Figure 2:
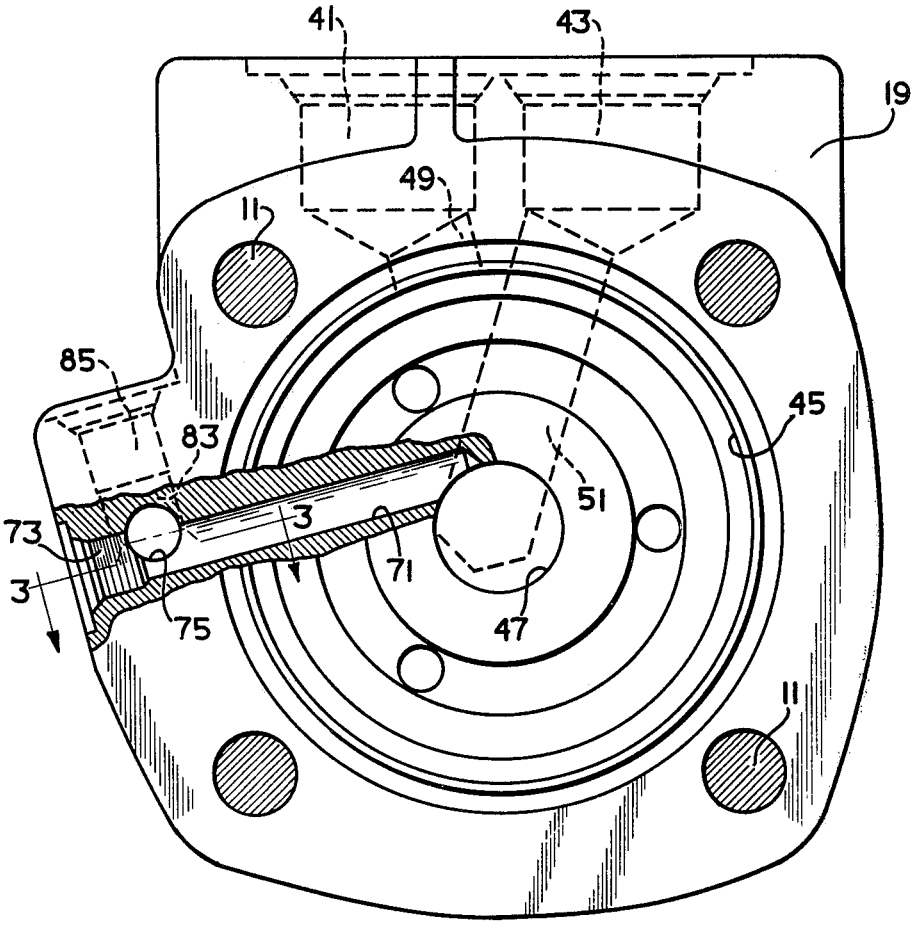
FIG. 2 is a transverse, partly broken away, view of the valve housing only, taken on line 2—2 of FIG. 1.

The hydraulic motor illustrated in FIG. 1 comprises a plurality of sections secured together, such as by a plurality of bolts 11 (see also FIG. 2). The motor includes a flange mounting portion 13, a gerotor displacement mechanism 15, a port plate 17, and a valve housing portion 19.

The gerotor displacement mechanism 15 is well known in the art and will be described only briefly herein. In the subject embodiment, the displacement mechanism 15 is a Geroler® displacement mechanism comprising a stationary ring member 21 defining a plurality of generally semicylindrical openings, and rotatably disposed in each of the openings is a cylindrical member 23. The ring member 21 and the plurality of cylindrical members 23 comprise an internally-toothed assembly. Eccentrically disposed within the internally-toothed assembly is an externally-toothed rotor member 25, which typically has one less external tooth than the number of cylindrical teeth 23, thus permitting the rotor member 25 to orbit and rotate relative to the internally-toothed assembly. The relative orbital and rotational movement between the internally-toothed assembly and the rotor member 25 defines a plurality of expanding and contracting volume chambers 27, as is well known in the art.

The rotor member 25 defines a set of internal, straight splines 29, and in engagement therewith is a set of external, crowned splines 31 formed on one end of a drive shaft 33. Disposed at the opposite end of the drive shaft 33 is another set of external, crowned splines 35, adapted to be in engagement with a set of internal, straight splines, defined by the input member of an associated device (not shown herein). By way of example only, the associated device may be a planetary gear reducer, in which case the input member which receives the external splines 35 would typically be the input sun gear.

As indicated previously, the present invention may be utilized with a standard motor, rather than the bearingless motor of FIG. 1. If the motor of FIG. 1 were to be converted to a standard motor, the flange mounting portion 13 would be replaced by a shaft support housing. Rotatably disposed within that housing would be an output shaft member defining internal splines adapted to receive the external splines 35. Disposed between the output shaft and the shaft support housing would be two sets of bearings, such as tapered thrust bearings. Thus, with the above items replaced by the flange mounting portion 13, the motor of FIG. 1 is referred to as "bearingless".

The valve housing portion 19 defines a pair of fluid pressure ports 41 and 43, and a pair of concentric annular chambers 45 and 47. The fluid port 41 communicates with the annular chamber 45 by means of a fluid passage 49, while the fluid port 43 communicates with the annular chamber 47 by means of a fluid passage 51. Rotatably disposed within the annular chamber 45, and in sealing engagement with the adjacent surface of the port plate 17, is a rotatable valve member 53 which defines a set of internal splines 55. As is well known in the art, the valve member 53 rotates at the rotational speed of the rotor member 25 by means of a valve drive shaft 57. The valve drive shaft 57 defines a set of external splines 59, in engagement with the internal splines 29, and a set of external splines 61, in engagement with the set of internal splines 55.

The valve member 53 defines a plurality of alternating valve passages 63 and 65, the valve passages 63 being in continuous fluid communication with the annular chamber 45, and the valve passages 65 being in continuous fluid communication with the annular chamber 47. In the subject embodiment, there are six of the valve passages 63, and six of the valve passages 65, corresponding to the six external teeth of the rotor member 25.

The port plate 17 defines a plurality of fluid passages 67, each of which is disposed to be in continuous fluid communication with the adjacent volume chamber 27. In operation, pressurized fluid entering the fluid port 41 will flow through the passage 49 into the annular chamber 45, then through each of the valve passages 63, then through each of the fluid passages 67 which is instantaneously in fluid communication with one of the expanding volume chambers. At the same time, fluid will flow from each of the contracting volume chambers, through each of the fluid passages 67 which is instantaneously in communication therewith, then through the respective valve passages 65 into the annular chamber 47. Exhaust fluid in the chamber 47 flows through the fluid passage 51 to the fluid port 43, from where it typically flows to the system reservoir (not shown).

With the above-described flow path, the movement of the rotor member 25, and thus the drive shaft 33, will include a rotational component, with the rotation being in a counterclockwise direction as the motor is viewed from the left in FIG. 1. It will be apparent to those skilled in the art that if pressurized fluid is communicated to the fluid port 43, and the fluid port 41 is connected to the system reservoir, the rotational component of the movement will be in a clockwise direction.

Disposed in sealing engagement against the rearward surface of the valve member 53 is a pressure balancing ring 69, which is described and illustrated in greater detail in the above-cited U.S. Pat. No. 3,572,983, and which forms no part of the present invention. A primary function of the balancing ring 69 is to exert a predetermined biasing force on the valve member 53, against the port plate 17, while at the same time preventing fluid communication between the annular chambers 45 and 47, one of which contains fluid at a relatively higher pressure, and the other of which contains fluid at a relatively lower pressure.

Although the present invention is being illustrated and described in connection with a hydraulic motor of the type in which the displacement mechanism is a gerotor, it should be clearly understood that the invention is not so limited, but could be used with hydraulic motors having various other types of displacement mechanisms. It is essential only that the mechanism define expanding and contracting fluid volume chambers. Similarly, the present invention is not limited to hydraulic motors utilizing the type of valve arrangement illustrated and described herein. It is essential only that the valve arrangement cooperate with the housing to define a fluid passage providing communication between one of the fluid ports and the expanding volume chambers, and another fluid passage providing communication between the other fluid port and the contracting volume chambers.

Figure 3:
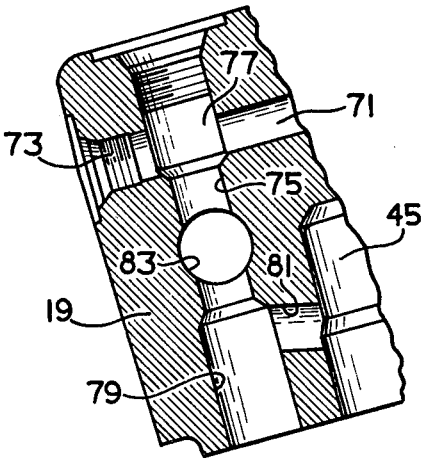
FIG. 3 is a fragmentary cross section, taken on line 3—3 of FIG. 2, showing the portion of the valve housing containing the shuttle valve assembly of the present invention.

With reference to FIG. 2, there will now be described the portion of the valve housing 19 in which the shuttle valve assembly of the present invention is located, in the subject embodiment. It should be noted that FIG. 2 is a view of the valve housing 19 alone, with everything removed except the bolts 11. The same is also true in regard to FIG. 3. In FIGS. 2 and 3, the shuttle valve assembly is not shown, to facilitate description of the various bores and passages associated with the shuttle valve assembly.

The valve housing 19 defines a transverse bore 71 which is in fluid communication with the annular chamber 47 (FIG. 2), and terminates in an internally-threaded portion 73. The valve housing portion 19 also defines an axially oriented bore 75 which includes an enlarged pressure chamber 77, and an enlarged pressure chamber 79. The transverse bore 71 intersects the pressure chamber 77 and is in fluid communication therewith. The valve housing 19 also defines a transverse bore 81 which extends between the annular chamber 45 and the pressure chamber 79 to provide fluid communication therebetween. The valve housing 19 further defines a fluid passage 83 which is in fluid communication with the axial bore 75, and terminates in an internally-threaded shuttle port 85 (FIG. 2). Although, in the subject embodiment, the portion of the housing which embodies the shuttle valve assembly is illustrated as being integral with the main motor housing, it should be understood that within the scope of the invention, the shuttle valve housing could be separate from the motor housing. For example, the shuttle valve housing could comprise a separate bolt on unit. However, where possible, the integral approach is preferred, to minimize plumbing fittings and assembly time.

As mentioned in the Background of the present specification, the shuttle port would typically be connected to a cooler line to divert a certain amount of fluid from the low pressure side of the closed loop hydraulic circuit, and direct such fluid through a heat exchanger. Therefore, the primary function of a shuttle valve assembly in a hydraulic motor of the type described herein is to permit fluid communication from the low pressure fluid path to the shuttle port 85, while preventing fluid communication from the high pressure fluid path to the shuttle port 85.

Figure 4:
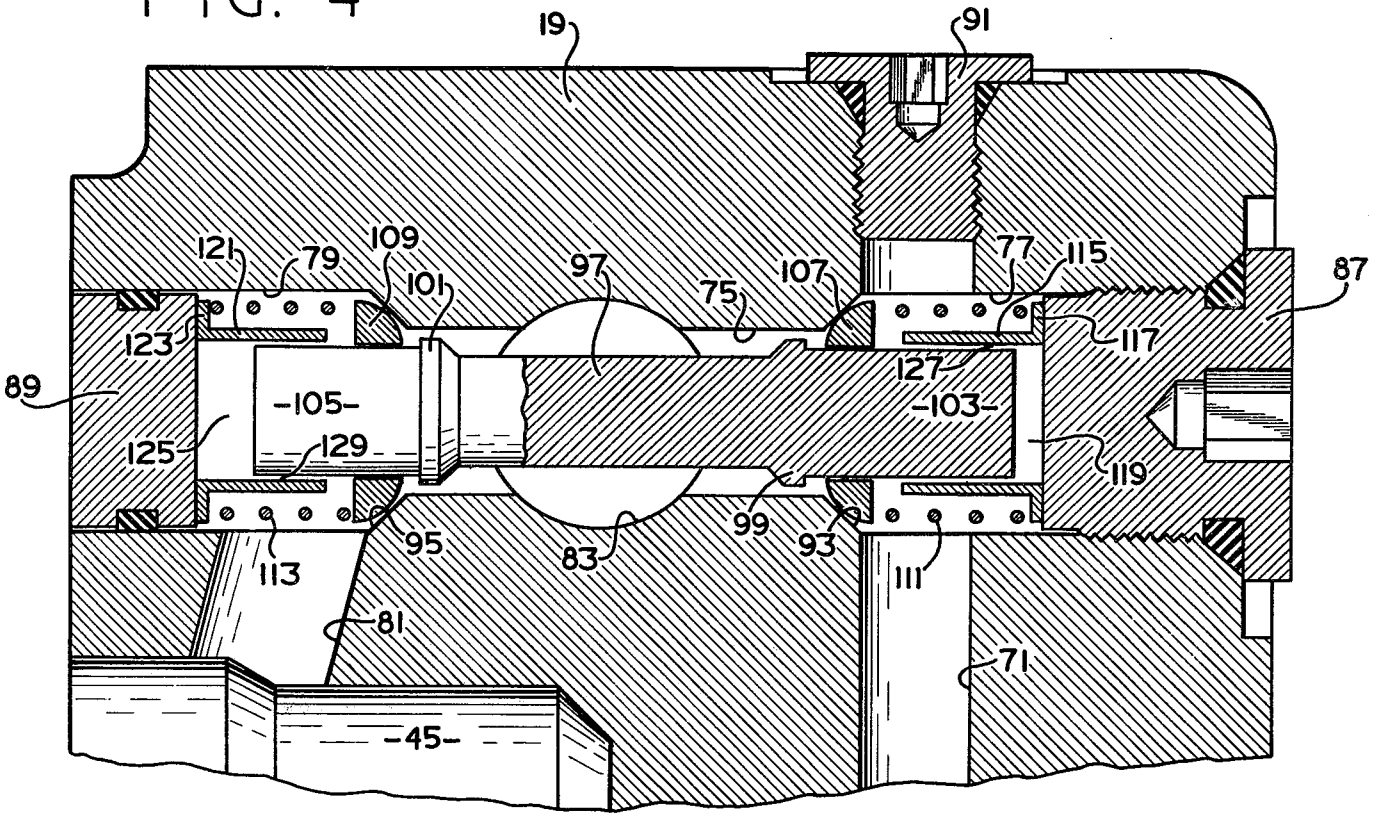
FIG. 4 is an enlarged, fragmentary cross section, similar to FIG. 3, illustrating the shuttle valve assembly of the present invention.

Referring now to FIG. 4, the shuttle valve assembly of the present invention will be described in detail. As an aid in understanding the ensuing description, it should first be noted that FIG. 4 illustrates substantially the same portion of the valve housing 19 as does FIG. 3, but on a scale approximately three times that of FIG. 3. However, in FIG. 4 the view is oriented to coincide with the view of FIG. 1, i.e., the lefthand surface of the valve housing 19, as shown in FIG. 4, is the surface which is disposed to engage the righthand surface of the port plate 17 in FIG. 1.

In engagement with a set of internal threads disposed at the right end of the pressure chamber 77 is a threaded plug member 87. Disposed in sealing engagement within the left end of the pressure chamber 79 is a cylindrical sealing member 89, the lefthand surface of which engages the adjacent surface of the port plate 17. Disposed in engagement with the internally-threaded portion 73 of the transverse bore 71 is a threaded plug member 91. Therefore, if the shuttle valve assembly seals the pressure chambers 77 and 79, the fluid pressure in the pressure chamber 77 will be the same as in the annular chamber 47, and the fluid pressure in the pressure chamber 79 will be the same as in the annular chamber 45.

In the subject embodiment, the axial bore 75 opens into the pressure chamber 77 at a frusto-conical surface 93 which comprises a shuttle valve seat. Similarly, the axial bore 75 opens into the pressure chamber 79 at a frusto-conical surface 95 which defines the other shuttle valve seat. The shuttle valve assembly comprises a shuttle piston assembly including an axially-movable piston member 97. The piston member 97 includes a pair of integrally-formed shoulders 99 and 101, the function of which will become apparent subsequently, and a pair of slightly enlarged end portions 103 and 105. Movably disposed about the end portions 103 and 105 is a pair of annular poppet members 107 and 109, respectively. The poppet member 107 is biased toward engagement with the valve seat 93 by means of a biasing spring 111, and similarly, the poppet member 109 is biased toward engagement with the valve seat 95 by means of a biasing spring 113. If the fluid pressure in the annular chambers 45 and 47 is approximately the same, which occurs primarily when the hydraulic motor is not operating, the shuttle valve assembly will be in its neutral or centered position as shown in FIG. 4. In the subject embodiment, the shuttle valve assembly is of the closed center type, i.e., when the piston member 97 is centered, both of the poppet members 107 and 109 are closed, preventing flow from either of the pressure chambers 77 or 79 to the shuttle port 85. However, it should be understood that the present invention may also be applied advantageously to a shuttle valve assembly of the open center type, i.e., one in which the neutral or centered position of the shuttle piston permits fluid communication from both of the pressure chambers to the shuttle port. It should be noted that the shuttle valve assembly of the present invention would be of the open center type if the shoulders 99 and 101 were disposed further apart axially, such that with the piston member 97 centered, the poppet members 107 and 109 would be held out of engagement with the valve seats 93 and 95, respectively, by the shoulders 99 and 101, respectively.

Disposed about the end portion 103 of the piston member 97 is a generally cylindrical dampening sleeve 115 including a radially-extending flange portion 117. The interior surface of the dampening sleeve 115 cooperates with the end portion 103 and member 87 to define a fluid pocket 119. Similarly, disposed about the end portion 105 of the piston member 97 is a generally cylindrical dampening sleeve 121 including a radially-extending flange portion 123. The interior surface of the dampening sleeve 121 cooperates with the end portion 105 and the member 89 to define a fluid pocket 125. The flange portion 117 acts as a seat for the biasing spring 111, while the flange portion 123 acts as a seat for the biasing spring 113. However, it should be noted that the flange portions 117 and 123 are sized, relative to the pressure chambers 77 and 79, respectively, to permit a certain amount of radial movement of the dampening sleeves 115 and 121. In the subject embodiment, the dampening sleeves 115 and 121 comprise screw machine parts, although they could also be stamped, or made in any number of other ways.

The interior surface of the dampening sleeve 115 is closely spaced apart from the exterior surface of the end portion 103 to define a dampening orifice 127. Similarly, the interior surface of the dampening sleeve 121 is closely spaced apart from the exterior surface of the end portion 105 to define a dampening orifice 129. As is well known in the shuttle valve art, if the fluid pressure in the pocket 125 is greater than the fluid pressure in the pocket 119, the piston member 97 will be biased to the right in FIG. 4, such that the shoulder 99 will move the poppet member 107 out of engagement with the valve seat 93 and permit flow of low pressure fluid from the annular chamber 47, through the transverse bore 71, through the pressure chamber 77 past the valve seat 93, then through the axially bore 75, and through the passage 83 to the shuttle port 85.

As was described in the Background of the present specification, the problem of "hunting" by the shuttle assembly occurs when there is a relatively small operating pressure differential, i.e., a relatively small pressure differential between the annular chambers 45 and 47. The present invention solves the problem of "hunting" as well as several other problems to be noted hereinafter. As the fluid pressure in the annular chamber 45 increases above the pressure in the annular chamber 47, instead of the fluid pressure in the pocket 125 quickly rising above the fluid pressure in the pocket 119, the restricted fluid communication between the pressure chamber 79 and the pocket 125, through the dampening orifice 129, results in a relatively slow, steady rise in fluid pressure in the pocket 125. At the same time, as the piston member 97 begins to move to the right, the fluid in the pocket 119 cannot be displaced quickly, but is displaced slowly through the dampening orifice 127, further limiting the speed of movement of the piston member 97.

In addition to dampening the movement of the shuttle assembly, and eliminating the problem of hunting, the present invention does so in a manner which does not introduce other problems. For example, if the dampening orifice were to be formed between the end portion 103 of the piston member 97 and an interior surface defined by either the housing portion 19 or the plug member 87, it would be difficult during manufacture to maintain sufficiently accurate concentricity between the interior surface, and the exterior surface of the end portion to be received therein. However, because the dampening sleeves of the present invention are radially movable within the pressure chambers, the concentricity problem is eliminated. The dampening sleeve will "follow" the end portion of the piston member but will not effect the centering of the shuttle assembly in the radial direction. Of course, the flow area of the dampening orifice is unaffected by radial movement of the dampening sleeve, relative to the piston member.

Another function of the present invention relates to the fact that shuttle assemblies of the type shown herein are normally unguided during shifting. For example, without the present invention, as the piston member 97 moves to the right in FIG. 4, there is nothing to prevent the end portion 103 and poppet member 107 from moving radially off center (the axis of the piston member 97 would no longer be parallel to the axis of the bore 75). Such misalignment can cause delays in recentering of the shuttle assembly to close off flow to the shuttle port, which can interfere with proper operation of the hydraulic motor. Although the dampening sleeves have been described as being radially movable, it should be noted that the flange portions 117 and 123 limit the radial movement sufficiently to prevent the type of substantial misalignment during shifting described above.

Finally, it is frequently desirable in shuttle assemblies of the type shown herein to provide some type of positive limit on the axial movement of the shuttle assembly in either direction. This is primarily to prevent excessive compression of the springs, which can lead to early fatigue failure of the springs. In the subject embodiment, the axial length of the dampening sleeves is selected such that the dampening sleeves inherently perform this function. As the piston member 97 moves to the right in FIG. 4, the shoulder 99 moves the poppet member 107 to the right until it engages the left end of the cylindrical dampening sleeve 115, thus limiting both the movement of the shuttle assembly, as well as the compression of the biasing spring 111. It will be appreciated by those skilled in the art that this last-noted function of the dampening sleeves also contributes to elimination of the hunting problem because the spring 111 has not been compressed to the extent that it will subsequently be able to exert sufficient force to move the poppet member rapidly into engagement with the valve seat 93, which is one cause of the clicking noise heard during hunting by prior art shuttle assemblies. In some cases, however, it may be preferred not to use the dampening sleeves to limit travel of the shuttle assembly, in which case a positive limit on shuttle travel can be achieved in some other way, such as utilizing a longer piston member 97, with the end portion 103 engaging the plug member 87 (or the end portion 105 engaging the member 89).

Although no dimensions have been provided herein for the dampening sleeves or the dampening orifices, it is believed to be within the ability of one skilled in the art to select appropriate dimensions based upon a reading and understanding of the present specification, in conjunction with the particular application for the present invention. It should also be noted that in certain applications, it may be adequate to provide only one dampening sleeve. Typically, this would be true on hydraulic motors which are normally unidirectional. In such an application, the dampening sleeve is preferably included in the pressure chamber which is normally at high pressure. It is believed that various other alterations and embodiments of the present invention may occur to those skilled in the art upon a reading and understanding of the present specification, and it is intended that all such alterations and modifications are included within the scope of the invention, insofar as they come within the scope of the appended claims.

What is claimed is:

1. A rotary fluid pressure device, comprising:

(a) housing means defining a high pressure fluid port, a low pressure fluid port and a shuttle port;

(b) a fluid pressure actuated displacement mechanism including a movable member, said mechanism defining expanding and contracting fluid volume chambers during movement of said movable member, said movement of said member including a rotational component;

(c) output shaft means operable to transmit said rotational component of movement of said movable member;

(d) valve means disposed within said housing means, and cooperating therewith to define first fluid passage means providing fluid communication between said high pressure port and said expanding volume chambers, and second fluid passage means providing fluid communication between said low pressure port and said contracting volume chambers;

(e) shuttle valve means including means defining a shuttle bore in fluid communication with said shuttle port, a high pressure chamber in fluid communication with said first fluid passage means, and a low pressure chamber in fluid communication with said second fluid passage means, said low pressure chamber and said shuttle bore intersecting in a valve seat, said shuttle valve means including an axially movable shuttle piston assembly including a piston member having a first end normally extending into said high pressure chamber and a second end normally extending into said low pressure chamber;

(f) said shuttle valve means including dampening means disposed within said high pressure chamber and being radially movable therein, in a direction transverse to the longitudinal axis of the shuttle bore, said dampening means defining an interior surface adapted to receive said first end of said shuttle piston member and be closely spaced apart therefrom to define a dampening orifice therebetween, said interior surface of said dampening means and said first end of said shuttle piston member cooperating to define an included fluid pocket, the fluid pressure in said pocket being effective to bias said shuttle piston assembly toward a position in which said shuttle piston assembly is disengaged from said valve seat permitting fluid communication between said low pressure chamber and said shuttle port, and said dampening orifice providing substantially restricted fluid communication between said high pressure chamber and said fluid pocket.

2. A rotary fluid pressure device comprising:

(a) housing means defining a first fluid pressure port, a second fluid pressure port, and a shuttle port;

(b) a fluid pressure actuated displacement mechanism including a movable member, said mechanism defining expanding and contracting fluid volume chambers during movement of said movable member, said movement of said member including a rotational component;

(c) output shaft means operable to transmit said rotational component of movement of said movable member;

(d) valve means disposed within said housing means, and cooperating therewith to define first fluid passage means providing fluid communication between said first pressure port and said expanding volume chambers, and second fluid passage means providing fluid communication between said second pressure port and said contracting volume chambers;

(e) shuttle valve means including means defining a shuttle bore in fluid communication with said shuttle port, a first pressure chamber in fluid communication with said first fluid passage means and a second pressure chamber in fluid communication with said second fluid passage means, said shuttle valve means including an axially movable shuttle piston assembly including a piston member having first and second end portions normally extending into said first and second pressure chambers, respectively;

(f) said shuttle valve means including first and second dampening means disposed within said first and second pressure chambers, respectively, and being radially movable therein, in a direction transverse to the longitudinal axis of the shuttle bore, said first and second dampening means being disposed in surrounding relationship to said first and second end portions of said shuttle piston member, and being closely spaced apart therefrom to define first and second dampening orifices therebetween, said first and second end portions of said shuttle piston member being exposed to fluid pressure within the first and second pockets defined by said first and second dampening means, respectively, said first and second dampening orifices providing substantially restricted fluid communication between said first and second pressure chambers and said first and second fluid pockets, respectively.

3. A device as claimed in claim 1 or 2 wherein said housing means includes a valve housing portion defining said fluid ports and said shuttle port, said valve means being rotatably disposed within said valve housing portion, said valve housing portion defining said shuttle bore and said pressure chambers.

4. A device as claimed in claim 1 or 2 wherein said shuttle piston assembly includes a pair of shuttle poppet members disposed about said piston member, and capable of axial movement relative thereto.

5. A device as claimed in claim 1 or 2 wherein said dampening means comprises a hollow, generally cylindrical member, and including means for limiting radial movement of said cylindrical member to insure proper alignment of said shuttle piston assembly during axial movement thereof.

6. A device as claimed in claim 1 or 2 wherein said displacement mechanism comprises an internally-toothed member and an externally-toothed member eccentrically disposed within said internally-toothed member for relative orbital and rotational movement therebetween.

7. A device as claimed in claim 3 wherein said internally-toothed member is stationary and said externally-toothed member orbits and rotates therein.

8. A device as claimed in claim 1 or 2 wherein said dampening means comprises a hollow, generally cylindrical member and means for maintaining the axial location of said cylindrical member generally constant.

9. A device as claimed in claim 8 wherein said maintaining means comprises:

(a) said cylindrical member having a flange portion extending generally radially outwardly; and (b) spring means having one end thereof seated against said flange portion and another end seated against a poppet member disposed about said piston member and being axially movable relative thereto.

* * * * *